US010544000B2

(12) United States Patent
Suzuki

(10) Patent No.: US 10,544,000 B2
(45) Date of Patent: Jan. 28, 2020

(54) CONVEYANCE DEVICE AND IMAGE FORMING APPARATUS TO OUTPUT POWER IN RESPONSE TO RECEIVING A ROTATION DETECTION SIGNAL WHEN THE CONVEYANCE DEVICE IS IN THE SLEEP MODE

(71) Applicant: Hideaki Suzuki, Kanagawa (JP)

(72) Inventor: Hideaki Suzuki, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 81 days.

(21) Appl. No.: 15/352,764

(22) Filed: Nov. 16, 2016

(65) Prior Publication Data

US 2017/0158448 A1 Jun. 8, 2017

(30) Foreign Application Priority Data

Dec. 2, 2015 (JP) ..... 2015-236075

(51) Int. Cl.
*B65H 16/00* (2006.01)
*G03G 15/00* (2006.01)

(52) U.S. Cl.
CPC ..... *B65H 16/005* (2013.01); *G03G 15/6529* (2013.01); *B65H 2801/36* (2013.01)

(58) Field of Classification Search
None
See application file for complete search history.

(56) References Cited

U.S. PATENT DOCUMENTS 6,724,493 B1 * 4/2004 Maruta ..... H04N 1/2307 358/1.14
7,375,713 B2 * 5/2008 Ota ..... G09G 3/20 345/100
8,023,125 B2 * 9/2011 Yamanaka ..... G06K 15/00 358/1.1
2004/0141198 A1 * 7/2004 Otsuki ..... B41J 11/009 358/1.12
2006/0066883 A1 * 3/2006 Takagi ..... B41J 13/103 358/1.12

(Continued)

FOREIGN PATENT DOCUMENTS

JP 8-320635 12/1996
JP 2005-017938 1/2005

*Primary Examiner* — Mohammad H Ghayour
*Assistant Examiner* — Pawan Dhingra
(74) *Attorney, Agent, or Firm* — Harness, Dickey & Pierce, P.L.C.

(57) ABSTRACT

A conveyance device includes: a holder to hold a paper roll and rotate along with rotation of the paper roll; a conveyor to convey a sheet located at an entry of a sheet conveyance path; a motor to apply a conveyance force to the conveyor; a first power supply circuit to output power both in a sleep mode and a ready mode; a second power supply circuit to output power in the ready mode but not in the sleep mode; a signal output unit supplied with the power from the first power supply circuit and to output a rotation detection signal when the holder rotates in the sleep mode or the ready mode; and a controller to, when the rotation detection signal is received in the sleep mode, turn on the second power supply circuit to supply the power to at least the motor to convey the sheet.

16 Claims, 7 Drawing Sheets

(56) References Cited

U.S. PATENT DOCUMENTS

2007/0016809 A1* 1/2007 Kida ..... G06F 1/3203
713/300
2007/0103702 A1* 5/2007 Yamamoto ..... G03G 15/0194
358/1.4
2007/0165262 A1* 7/2007 Watanabe ..... G03G 15/5004
358/1.14
2007/0201076 A1* 8/2007 Ishida ..... G03G 15/5004
358/1.14
2007/0206211 A1* 9/2007 Okutsu ..... G03G 15/50
358/1.14
2010/0066004 A1* 3/2010 Shiraishi ..... B65H 7/14
271/3.16
2011/0244848 A1* 10/2011 Misumi ..... H04W 76/046
455/422.1
2012/0236353 A1* 9/2012 Nagayama ..... G03G 15/5004
358/1.13
2012/0272230 A1* 10/2012 Lee ..... G06F 1/329
717/173
2015/0256700 A1* 9/2015 Sakai ..... H04N 1/00891
358/1.13
2016/0062289 A1* 3/2016 Kawakami ..... G03G 15/5016
399/80
2016/0156799 A1* 6/2016 Ninomiya ..... H04N 1/00896
358/1.13
2016/0209907 A1* 7/2016 Han ..... G06F 1/3209

* cited by examiner

CONVEYANCE DEVICE AND IMAGE FORMING APPARATUS TO OUTPUT POWER IN RESPONSE TO RECEIVING A ROTATION DETECTION SIGNAL WHEN THE CONVEYANCE DEVICE IS IN THE SLEEP MODE

CROSS-REFERENCE TO RELATED APPLICATIONS

This patent application is based on and claims priority pursuant to 35 U.S.C. § 119(a) to Japanese Patent Application No. 2015-236075, filed on Dec. 2, 2015, in the Japan Patent Office, the entire disclosure of which is hereby incorporated by reference herein.

BACKGROUND

Technical Field

The present invention relates to a conveyance device and an image forming apparatus.

Description of the Related Art

Some apparatuses operate in "sleep mode" in which power supply to devices not in use is stopped (turned off) to suppress power consumption of the apparatus. When the apparatus receives a user instruction, for example, through a control panel for controlling such apparatus, the apparatus transitions from the "sleep mode" to "stand-by mode (ready mode)", in which power is supplied (turned on) to the devices not in use.

In the conveyance device that draws a sheet from roll paper and conveys the same, the roll paper is set while the device is in the stand-by mode to feed the sheet. However, it may not be possible for a user to check visually whether the device is in the sleep mode. If the device is in the sleep mode, the sheet may not be fed and conveyed. The user thus needs to check visually a control panel to see if the device is in the sleep mode, which has been cumbersome.

SUMMARY

Example embodiments of the present invention include a conveyance device, which includes: a holder to hold a paper roll and rotate along with rotation of the paper roll; a conveyor to convey a sheet located at an entry of a sheet conveyance path along the sheet conveyance path; a motor to apply a conveyance force to the conveyor to cause the conveyor to convey the sheet; a first power supply circuit to output power both in a sleep mode and a ready mode; a second power supply circuit to output power in the ready mode but not output power in the sleep mode; a signal output unit supplied with the power output from the first power supply circuit and to output a rotation detection signal when the holder rotates in either the sleep mode or the ready mode; and a controller to receive the rotation detection signal output from the signal output unit, and when the rotation detection signal is received in the sleep mode, the controller further turns on the second power supply circuit to supply the power to at least the motor to cause the conveyer to convey the sheet.

Example embodiments of the present invention include an image forming apparatus including the above-described conveyance device.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein.

Figure 1:
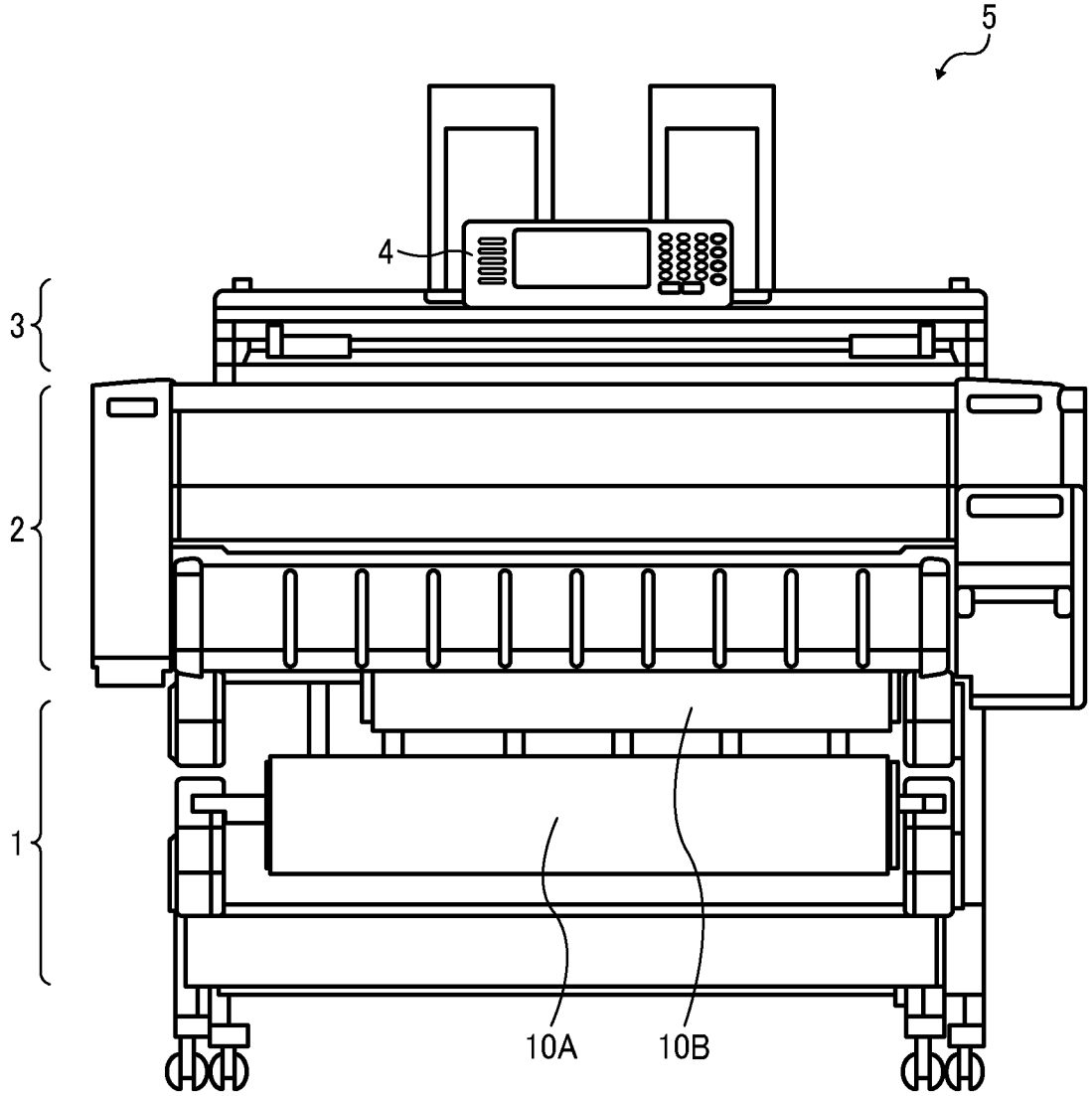
FIG. 1 is a diagram illustrating an image forming apparatus including a conveyance device, according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Embodiments of the present invention will be explained below with reference to the drawings.

<Image Forming Apparatus>

First, an image forming apparatus is described according to an embodiment of the present invention. The image forming apparatus of FIG. 1 includes a conveyance device to which an embodiment of the present invention is applied.

Figure 2:
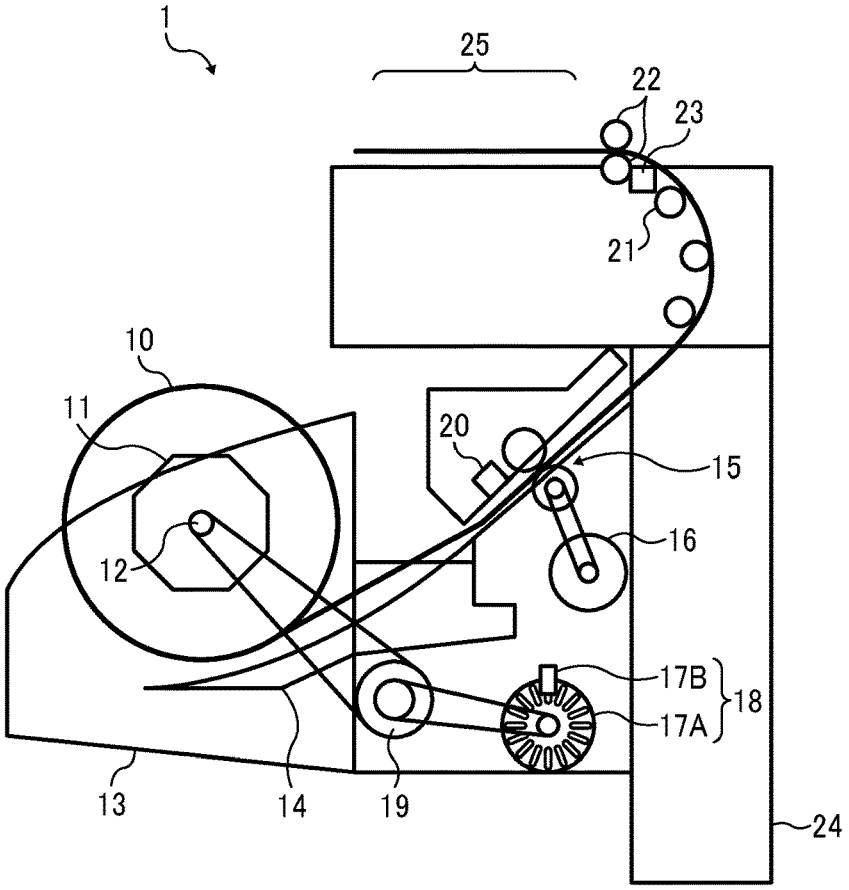
FIG. 2 is a cross-sectional view of the conveyance device (paper feeder) in the image forming apparatus of FIG. 1.
Figure 3:
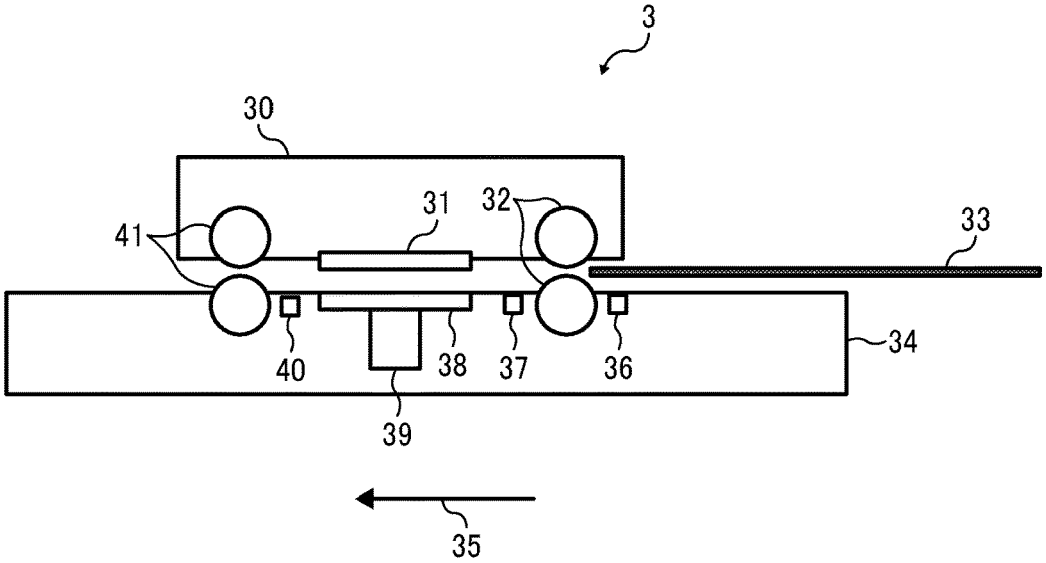
FIG. 3 is a cross-sectional view of a document reading device in the image forming apparatus of FIG. 1.

FIG. 1 is a diagram illustrating an image forming apparatus 5 according to the embodiment. FIG. 2 is a cross-sectional view of a conveyance device (paper feeder 1) in the image forming apparatus 5. FIG. 3 is a cross-sectional view of a document reading device (document reading device 3) in the image forming apparatus 5.

The image forming apparatus 5 includes the paper feeder 1 as the conveyance device that draws a sheet of paper from the paper roll and conveys the same, an image forming device 2 that forms an image on the drawn sheet; a document reading device 3 that reads a document into image data; and a control panel 4 that allows the user to operate the image forming apparatus 5.

The image forming apparatus 5 is implemented by a printer that reads a document into image data and forms an image based on the image data, or a multi-function printer (MFP) that has various functions including functions of scanning, printing, copying, and data transmission.

When the image forming apparatus 5 is not in use, the image forming apparatus 5 transitions to a sleep mode in which no power is supplied to some devices in the image forming apparatus 5 to save power consumption. With the occurrence of a predetermined event as a trigger, the image forming apparatus 5 transitions from the sleep mode to a ready mode to allow setting of paper roll or perform image formation.

In this embodiment, the paper feeder 1 stocks therein different types of paper rolls such as paper rolls 10A and 10B, which are vertically arranged in two stages. The number of the paper rolls may be three or more (N). The image forming device 2 forms an image on a sheet, which is conveyed from any one of the paper rolls 10A and 10B by the paper feeder 1. The image forming device 2 includes a printer 25 (FIG. 2), and a control circuit and the like. In the explanation of the embodiment, the image forming device 2 is described as an ink-jet type. However, the image forming device 2 may be an electrophotographic type. In the description of the embodiment, the term "paper" is used but a printing medium may not necessarily be "paper" but may be a film or the like.

The document reading device 3 includes an image sensor that reads the conveyed document into image data. The image sensor may include a unity-magnification optical system or a reduction optical system, or may be of any other type.

The control panel 4 includes a liquid crystal display (LCD) and mechanical keys. The control panel 4 is used to receive various operations from the user and provide notifications to the user. The control panel 4 may be a combination of the LCD and a touch panel.

In the sleep mode, the backlight of the operation part in the control panel 4 is turned off and nothing is displayed on the control panel 4, but the keys can be operated. A lamp indicating the sleep mode and others are on. In the case of using a touch panel, the touch panel can be operated even when the backlight is off. When the image forming apparatus 5 is in the sleep mode, power is supplied to only a selected number of devices to be ready for a transition from the sleep mode.

A large-sized paper roll is 1 m or more wide and 10 kg or more in weight. To replace the paper roll, the user needs to handle it by both hands in a leaning posture. At this time, the height of the control panel 4 is about 1.2 m, for example. Accordingly, during the replacement of the paper roll, the user cannot check visually the control panel. That is, during the replacement of the paper roll, the user cannot recognize whether the device is in the sleep mode.

<Paper Feeder>

Next, the paper feeder 1 will be explained. FIG. 2 is a cross-sectional view of the paper feeder 1 in the image forming apparatus 5.

At the image forming apparatus 5 illustrated in FIG. 1, the two paper rolls 10A and 10B are arranged in the paper feeder 1. In the following explanation, the paper roll in one of the two stages is described as paper roll 10.

The paper roll 10 is supported by a spool 11 as a holder including a shaft 12. The shaft 12 of the spool 11 includes a gear to transfer rotation of the paper roll 10. The spool 11 is supported by a paper feeding unit 13. The paper feeding unit 13 also supports other members.

A paper feeding guide 14 guides the sheet at the time of feeding the paper roll 10. Paired paper feeding rollers 15 include two upper and lower rollers. One of the rollers is driven and rotated by a paper feeding motor 16, and the other roller also rotates following the rotation of the one roller. By the rotation of the paired paper feeding rollers 15, the sheet in the paper roll 10 sandwiched between these rollers is conveyed in the upward direction.

The paper feeding motor 16 is driven and controlled by a central processing unit (CPU) 122 of a main control unit 120 (FIG. 4) to rotate the paired paper feeding rollers 15 and convey the sheet at the time of feeding the paper roll 10.

An encoder 18 includes an encoder sheet 17A and a sensor 17B. When the sheet of paper is drawn as the shaft 12 rotates, the encoder sheet 17A rotates via a pulley 19. The encoder sheet 17A has slits and black-and-white patterns formed thereon at specific intervals. The sensor 17B detects the slits and the black-and-white patterns to determine the amount of rotation of the paper roll 10.

The amount of rotation of the paper roll 10 is used to control the speed/conveyance amount at the time of paper feeding, calculate the used amount of the paper roll or the remaining amount of the paper roll, and detect various errors. For example, after a paper entry sensor 20 has detected the sheet of paper, and the encoder 18 is moving but the sheet has not been conveyed to reach a registration sensor 23 even after a lapse of a specific time, the occurrence of an error is detected on the assumption that there is some abnormality between the paper entry sensor 20 and the registration sensor 23.

At the time of paper feeding from the paper roll 10, when the user inserts the sheet of paper into the paper entry sensor 20, the paper entry sensor 20 detects the sheet, and the paper feeding motor 16 operates and conveys the sheet. Guide rollers 21 support the conveyed sheet and conveys the same to paired registration rollers 22 at the time of paper feeding from the paper roll 10. The paired registration rollers 22 are motor-driven to draw and convey the sheet of paper to the printer 25. In this example, the paper entry sensor 20 is disposed at or near an entry of paper feeding path, downstream the spool 11. The paper entry sensor 20 detects a sheet of paper, which is to be entered to the paper feeding path.

The registration sensor 23 is arranged downstream the paired registration rollers 22 to detect that the sheet has conveyed to the registration rollers 22. In FIG. 1, the reference sign 24 represents a main body frame of the image forming apparatus 5, and the reference sign 25 represents the printer. The printer 25 includes an ink-jet head, arranged on the upper part of the printer 25, which ejects an ink to form the image on the sheet of paper.

<Paper Feeding>

The procedure for setting the paper roll 10 in the paper feeder 1 and performing paper feeding is as described as follows: (1) the user sets the paper roll 10 in the paper feeding unit 13 through the spool 11; (2) the user manually conveys the front edge of the paper roll 10 to the detection position of the paper entry sensor 20; (3) when the paper entry sensor 20 of the image forming apparatus 5 detects the paper, the paper feeding motor 16 is driven to convey the paper roll 10; and (4) at the image forming apparatus 5, the front edge of the paper is conveyed to the paired registration rollers 22 and the registration sensor 23 detects the paper, whereby the conveyance of the paper is terminated.

The encoder 18 detects the amount of rotation of the paper roll 10 when the front edge of the paper roll 10 is manually conveyed to the detection position of the paper entry sensor 20, when the paper roll 10 is conveyed by the paper feeding motor 16, and when the front edge of the paper is conveyed to the paired registration rollers 22.

When the paper roll 10 is set, the paper feeding motor 16 may convey the paper. Accordingly, in the sleep mode in which no power is supplied to the paper feeding motor 16, the paper entry sensor 20, and the registration sensor 23, the set paper roll 10 cannot be fed.

To allow paper feeding in the sleep mode, it was necessary to supply power to the encoder 18, the paper entry sensor 20, the registration sensor 23, a motor driver 123 for driving the paper feeding motor 16, and a CPU in a control unit for controlling the motor driver 123. This leads to significant increase in power consumption of the image forming apparatus 5 in the sleep mode.

Accordingly, the image forming apparatus 5 of the embodiment is configured such that, in the sleep mode, a selected number of devices are caused to be on state for energy saving and the user is allowed to perform paper feeding not depending on return from the sleep mode by operating the operation part.

<Document Reading Device>

Next, the document reading device 3 will be explained. FIG. 3 is a cross-sectional view of the document reading device 3 in the image forming apparatus 5. FIG. 3 illustrates the image forming apparatus 5 illustrated in FIG. 1 from one side.

The document reading device 3 illustrated in FIG. 3 is a sheet-through type but the document reading device 3 may be any other type.

In the document reading device 3, an upper scanner frame 30 supports the upper side of front and back rollers and a white reference plate 31. The upper scanner frame 30 also supports the control panel 4. The white reference plate 31 is a white-color plate, which is used to generate white reference data at the time of image reading. Paired front rollers 32 are motor-driven to convey a document 33 by two upper and lower rollers of the front rollers 32. The paired front rollers 32 operate in conjunction with paired back rollers 41.

A lower scanner frame 34 supports the paired front rollers 32, the paired back rollers 41, a scanner sensor 36, a scanner registration sensor 37, a contact glass 38, an image sensor 39, and a document ejection sensor 40.

The scanner sensor 36 detects that the document 33 has been inserted from the right side of FIG. 3. The output of the scanner sensor 36 may be used to determine whether to transition from the sleep mode.

The scanner registration sensor 37 detects that the document 33 as it is being transferred in a conveyance direction 35. The contact glass 38 covers the upper part of the image sensor 39 to protect the image sensor 39.

The image sensor 39 includes an optical system having a light source, lenses, and the like to subject light reflected from the irradiated document 33 to photoelectric conversion into an electrical signal.

Upon completion of document reading, the document is further transferred to the document ejection sensor 40, at which the document ejection sensor 40 detects the paper ejection. The paired back rollers 41 convey the document 33 in conjunction with the paired front rollers 32.

<Document Reading Process>

Document reading process is performed as follows: (1) as the document 33 is placed above the scanner sensor 36, the scanner sensor 36 detects the document 33, and the paired front rollers 32 and the paired back rollers 41 are rotationally driven to sandwich and convey the document 33 in the conveyance direction 35; (2) when the document 33 is stopped once on the contact glass 38, the user presses a reading start button on the control panel 4 to further convey the document 33; (3) the paired front rollers 32 and the paired back rollers 41 are driven to convey the document 33 in the conveyance direction 35 while the document 33 is read by the image sensor 39; (4) after a specific time has elapsed since the trail edge of the document 33 passes through the scanner registration sensor 37, for example, after passage of the rear edge of the document 33 through the image sensor 39, the image sensor 39 terminates the reading; and (5) subsequently, the document 33 is still conveyed, and after the passage of the rear edge of the document 33 through the document ejection sensor 40, the paired front rollers 32 and the paired back rollers 41 are stopped.

First Embodiment

Figure 4:
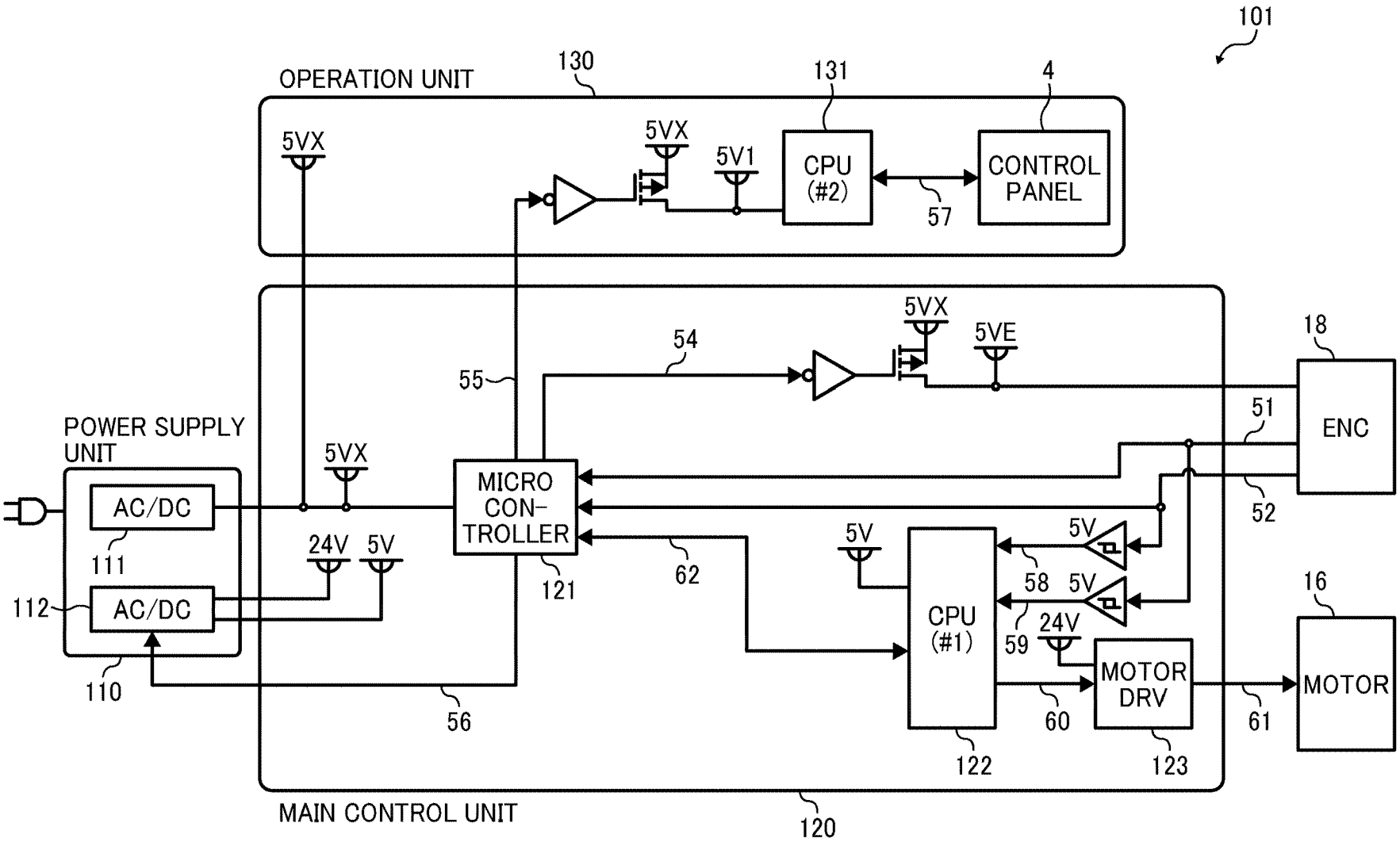
FIG. 4 is a block diagram of a control system for controlling operation of the conveyance device of FIG. 1, according to a first embodiment of the present invention.

Next, a process by the paper feeder 1 according to a first embodiment of the present invention will be explained. FIG. 4 is a block diagram of a control system 101 in the paper feeder 1 according to the first embodiment of the present invention.

This control system 101 of FIG. 4 includes a power supply unit 110, a main control unit 120, and an operation unit 130.

The power supply unit 110 includes a first power supply circuit 111 and a second power supply circuit 112. The main control unit 120 includes a microcontroller 121, a CPU (#1) 122, and a motor driver 123. The operation unit 130 includes a CPU (#2) 131 and a control panel 4. The control panel 4 is controlled by the CPU (#2) 131 and is turned off when no power is supplied to the CPU (#2) 131.

<Power Supply Unit>

First, the power supply unit 110 will be explained.

The first power supply circuit 111 outputs power of "5VX."

The second power supply circuit 112 generates power of "5V" or "24V," and supplies or stops the power as appropriate.

In a "sleep mode," the first power supply circuit 111 outputs power but the second power supply circuit 112 does not output power.

In this example, powers illustrated in FIG. 4 are defined as follows:

"5VX": Turned on when the power cord is inserted into the receptacle. This power supply always outputs power of "5V."

"5VE": Turned off when no power is supplied and turned on even in the sleep mode when power is supplied. This is generated from power of "5VX" based on input of a signal 54.

"5V": Turned off in the sleep mode when no power is supplied and turned on in the ready mode.

"5V1": Turned off in the sleep mode when no power is supplied and turned on in the ready mode. This is generated from power of "5VX" based on input of a signal 55.

"24V": Turned on or off at the same timing as "5V." This is used for power supply to the motor system.

In the power supply unit 110, the first power supply circuit 111 converts alternating current (AC) power into direct current (DC) power and outputs power of "5VX." The second power supply circuit 112 converts AC power into DC power and outputs powers "5V" and "24V" The first power supply circuit 111 and the second power supply circuit 112 may share a circuit for smoothing AC power or may be have their respective ones. In this example, the second power supply circuit 112 is controlled by a signal 56 from the microcontroller 121 and does not output powers of "5V" and "24V" in the sleep mode.

<Main Control Unit>

The main control unit 120 is a control circuit that controls processes other than ones by the control panel 4, that is, paper feeding, image formation, and reading.

The microcontroller 121 controls transition of an operating mode, such as, from the sleep mode to the ready mode. The microcontroller 121 is supplied with power of "5VX" (or a voltage generated from "5VX") from the first power supply circuit 111 and operates at any time. The microcontroller 121 also controls turning on/off of the main power source.

The CPU (#1) 122 performs various controls. The CPU (#1) 122 is supplied with power of "5V" (or a voltage generated from "5V") from the second power supply circuit 112 and is turned off in the sleep mode.

The main control unit 120 is connected to the encoder (ENC) 18. The paper feeder 1 according to the embodiment includes two paper rolls 10A and 10B, and the encoder 18 outputs two encoder signals 51 and 52.

The encoder signals 51 and 52 are transmitted to the CPU (#1) 122 and used for various controls.

In addition, the two encoder signals 51 and 52 are input into the microcontroller 121, and are XORed and processed as one signal within the microcontroller 121.

When there are N paper rolls, the encoder 18 outputs N encoder signals. In this case, the N encoder signals are XORed into one signal within the microcontroller 121.

The encoder 18 is supplied with power of "5VE" from the first power supply circuit 111. Accordingly, the encoder 18 is energized even in the sleep mode.

<Paper Feeding Motor>

The paper feeding motor (motor) 16 is driven by the motor driver 123 into which power of "24V" from the second power supply circuit 112 is input. The motor driver 123 is controlled by a control signal 60 input from the CPU (#1) 122. Accordingly, the paper feeding motor 16 does not operate in the sleep mode. The motor driver 123 is also driven by power of "24V" from the second power supply circuit 112 and is turned off in the sleep mode. In addition, the microcontroller 121 and the CPU (#1) 122 communicate with each other via a signal 62 to exchange information once the operating state transitions from the sleep mode and the like.

<Operation Unit>

The operation unit 130 includes the control panel 4 as described above that serves as an interface for display or user operation. The control panel 4 is driven by power of "5V1" generated from power of "5VX" by the signal 55, and is turned off in the sleep mode and is turned on only in the ready mode.

<Transition From the Sleep Mode to the Ready Mode>

The paper feeder 1 transitions from the sleep mode after paper feeding according to the following procedure: (1) when the user sets the paper roll 10A or 10B and starts a paper feeding operation (rotation and insertion into the paper entry sensor 20), the shaft 12 rotates and the encoder 18 outputs the encoder signals 51 and 52; (2) the encoder signals 51 and 52 correspond to the respective paper feeding stages. When either of the paper rolls 10A and 10B is rotated, the encoder signal corresponding to the rotating paper roll is switched from "H" to "L." In addition, the encoder signals 51 and 52 are input into the microcontroller 121. The microcontroller 121 XORs the encoder signals 51 and 52. When either of the encoder signals 51 and 52 changes between H and L, the microcontroller 121 detects that the user is setting the paper roll. Accordingly, the paper feeder 1 transitions from the sleep mode to the ready mode. Specifically, the signal 55 is enabled and the CPU (#2) 131 is operated to cause the control panel 4 to transition; (3) similarly, the signal 56 is enabled to turn on powers of "24V" and "5V" to operate the CPU (#1) 122. Accordingly, the paper feeding motor 16 can be driven to start a paper feeding operation; and (4) when the paper roll is inserted to cause the paper feeder 1 to transition from the sleep mode to the ready mode, the control panel 4 is brought into the ready mode.

The control panel 4 is switched to the ready mode when the paper feeder 1 transitions from the sleep mode to the ready mode by the user inserting the paper roll because the user may operate the control panel 4 before the paper feeding motor 16 is driven to convey the paper to the registration sensor 23 after the paper is sandwiched between paired paper feeding rollers 15. By operating the control panel 4, the user selects the type of paper (paper size and thickness) or confirms whether to perform the paper feeding operation.

The paper entry sensor 20 is supplied with power of "5V." Unlike in the foregoing embodiment, the encoder 18 may be supplied with power of "5V" and the paper entry sensor 20 may be supplied with power of "5VE" so that the paper feeder 1 transitions from the sleep mode by turning on or off the paper entry sensor 20.

In such a case, however, the operation of transitioning from the sleep mode is started only after the user enters the paper from the paper roll 10 into the paper entry sensor 20.

In this case, there is a time lag between the instant when the transition is started and the instant when the paper feeding motor 16 becomes capable of conveying the paper, depending on the start-up time of the CPU (#1) 122. In addition, the user has to hold the paper during that time.

As in the embodiment, the transition from the sleep mode based on the detection of rotation of the paper roll 10 by the encoder 18 is less prone to be affected by the time lag resulting from the start-up of the CPU (#1) 121 because the operation of making a transition from the sleep mode can be started by a user's "preliminary operation" of entering the paper.

The "preliminary operation" described above means the operation of rotating the paper into a position where the front end of the paper is easy to enter so that the paper can be inserted along the paper feeding guide 14 and the operation of entering the front end of the paper into the entry sensor 20 along the paper feeding guide 14.

As described above, according to the first embodiment, when the user is entering the paper into the paper feeding position, the encoder 18 detects the rotation of the spool 11 to output a rotation detection signal. Based on this rotation detection signal, the microcontroller 121 causes the second power supply circuit 112 to turn on power. Accordingly, the second power supply circuit 112 supplies power to the paper feeding motor 16 to convey the paper. This suppresses power consumption of the paper feeder 1 in the sleep mode. In addition, the paper feeding motor 16 is driven to convey the sheet of paper, which is entered into the paper entrance at the time of setting the paper roll 10, thus improving user operability.

Second Embodiment

Figure 5:
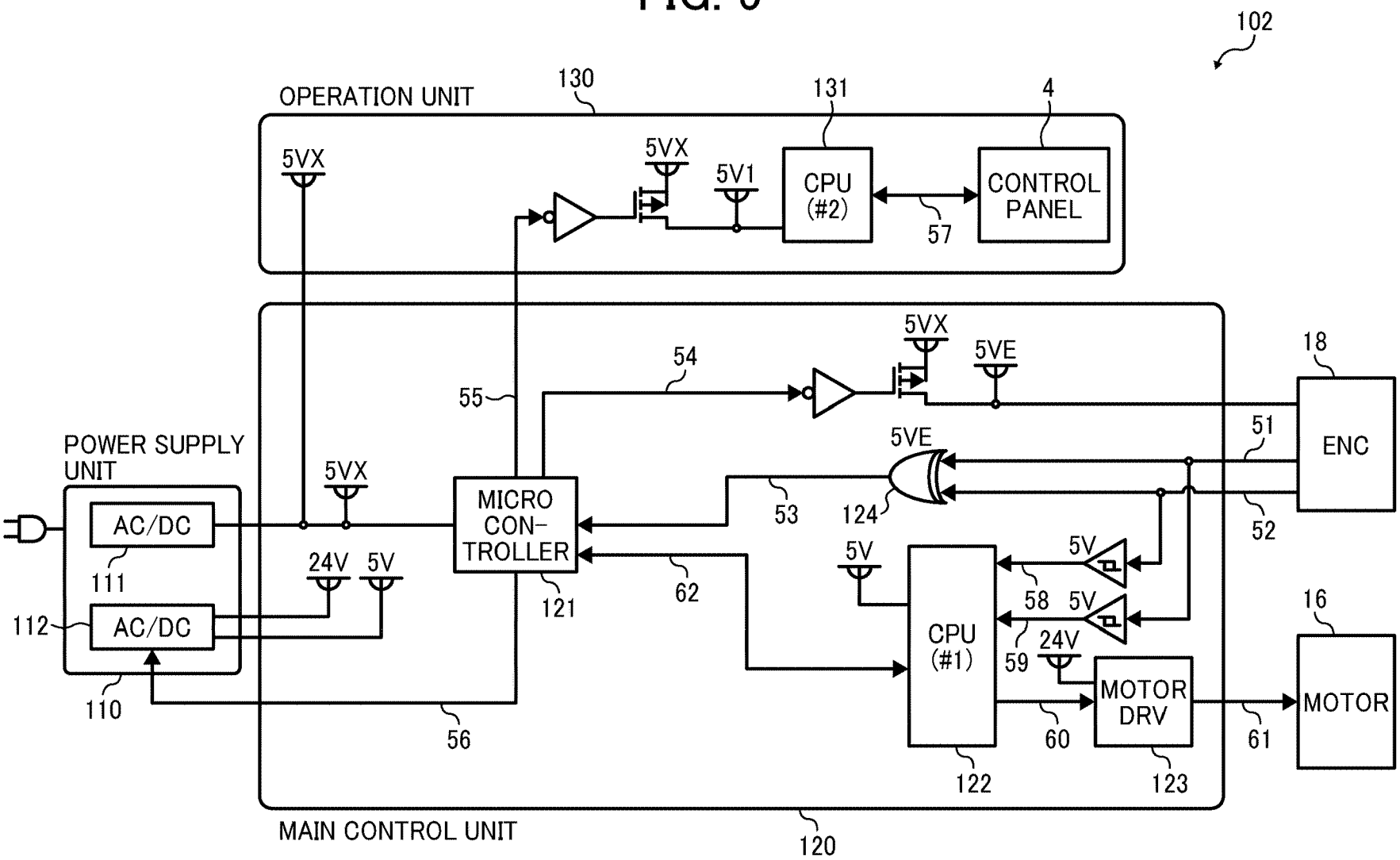
FIG. 5 is a block diagram of a control system for controlling operation of the conveyance device of FIG. 1, according to a second embodiment of the present invention.

Next, a process by the paper feeder 1 according to a second embodiment of the present invention will be explained. FIG. 5 is a block diagram of a control system 102 in the paper feeder 1 according to the second embodiment of the present invention.

The control system 102 of the second embodiment differs from the control system 101 of the first embodiment in that an XOR gate 124 is additionally provided, which outputs an XOR of encoder signals 51 and 52 from the encoder 18 to the microcontroller 121.

When the XOR gate 124 XORs the encoder signals 51 and 52 and either of paper rolls 10A and 10B is rotated, the signal 53 is switched to "H" or "L." This can eliminate one input signal to the microcontroller 121.

In the first embodiment, when the number of stages of paper rolls 10 in the paper feeder 1 is N, N signals are input into the microcontroller 121. Meanwhile, in the second embodiment, only one input signal is entered into the microcontroller 121.

Third Embodiment

Figure 6:
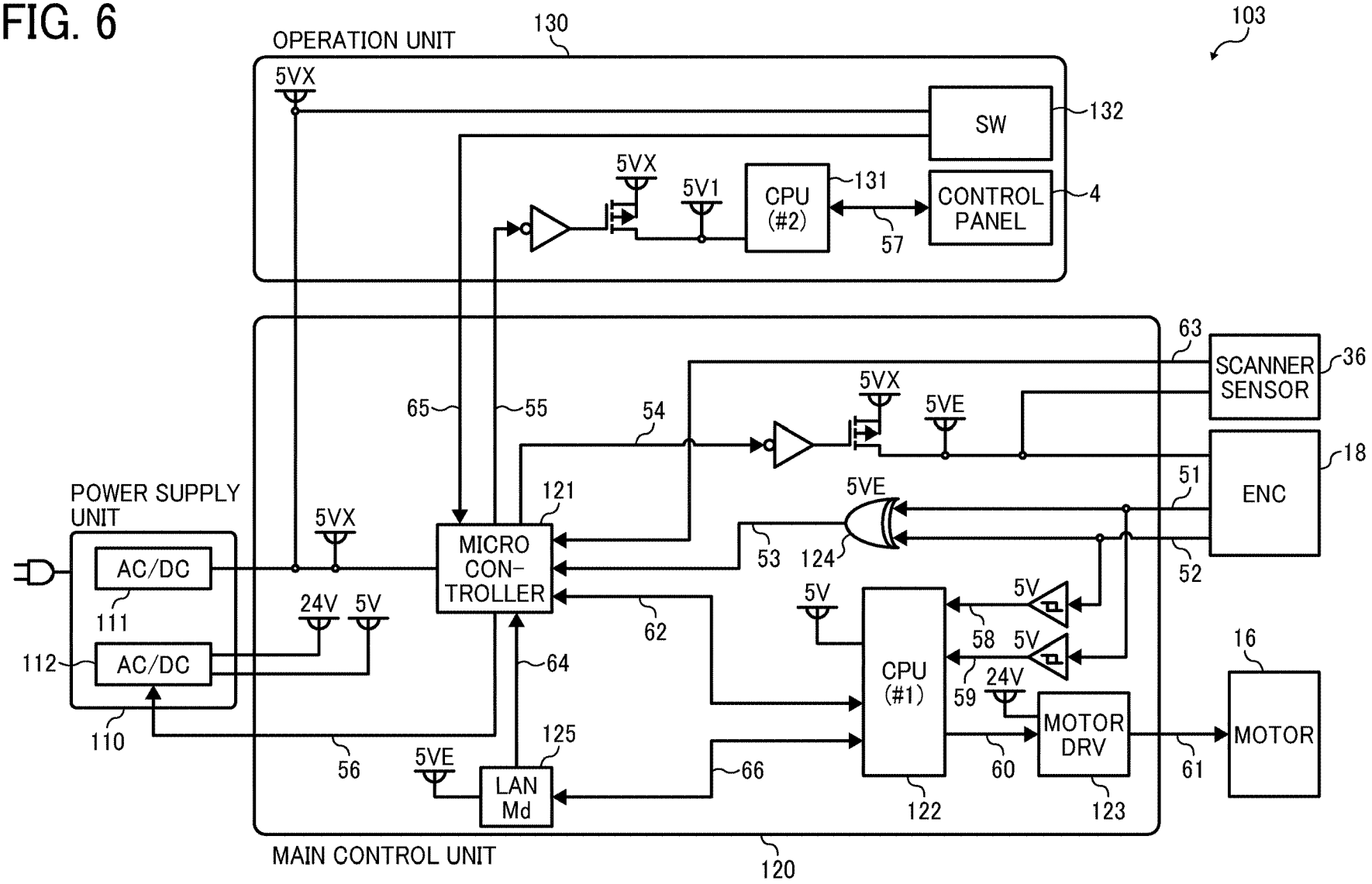
FIG. 6 is a block diagram of a control system for controlling operation of the conveyance device of FIG. 1, according to a third embodiment of the present invention.

Next, a process by the paper feeder 1 according to a third embodiment will be explained. FIG. 6 is a block diagram of a control system 103 in the paper feeder 1 according to the third embodiment of the present invention.

The paper feeder 1 according to the third embodiment of the present invention is connected to a local area network (LAN) and can be operated from an external computer (PC) or the like.

Accordingly, the main control unit 120 further includes a LAN module (LANMd) 125 that is a wired/wireless LAN interface as a device for external communication, and the operation unit 130 further includes a sleep mode return switch 132 as a device for clear signal output.

With this configuration, the control system 103 transitions from the sleep mode, by the sleep mode return switch 132 in the operation unit 130 or by a signal 64 from the LAN module 125.

The control system 103 of the third embodiment further makes a transition from the sleep mode by a signal 63 output from the scanner sensor 36. The process of making a transition from the sleep mode by the encoder 18 is the same as that in the second embodiment.

The sleep mode return switch 132 is supplied with power of "5VX" (or "5VE") and is still operational in the sleep mode.

The scanner sensor 36 is supplied with power of "5VE" and is still operational in the sleep mode.

The LAN module 125 is supplied with power of "5VE" (or power generated from "5VE") and is still operational in the sleep mode. In the third embodiment, the paper feeder 1 is connected to a LAN as an example. However, the third embodiment is also applicable to the case in which another communication device such as universal serial bus (USB) is used.

<Transition from the Sleep Mode>

The operation of transitioning from the sleep mode is performed according to the following procedure:

<Operation Panel>

(A) Transition from the sleep mode by the sleep mode return switch 132.

(1) The user presses the sleep mode return switch 132 to assert the signal 65.

(2) The microcontroller 121 detects the level of the signal 65 and asserts the signal 55.

Accordingly, power of "5V1" is generated to start the operation unit CPU (#2) 131.

(3) At the same time, the microcontroller 121 asserts the signal 56 and starts the second power supply circuit 112. Accordingly, powers of "24V" and "5V" are turned on to start the CPU (#1) 122.

(4) Accordingly, all the modules are caused to be in the operating state, while transitioning from the sleep state.

<Scanner Sensor>

(B) Transition from the sleep mode by the scanner sensor 36.

(1) When the document is inserted (or pulled out), the signal 63 from the scanner sensor 36 changes.

(2) The microcontroller 121 detects the edge in the signal 63 ("H" to "L" or "L" to "H") and asserts the signal 55. Accordingly, power of "5V1" is generated to start the operation unit CPU (#2) 131.

(3) At the same time, the microcontroller 121 asserts the signal 56 and starts the second power supply circuit 112. Accordingly, powers of "24V" and "5V" are turned on to start the CPU (#1) 122.

(4) Accordingly, all the modules are caused to be on, while transitioning from the sleep state.

<LAN Module>

(C) Transition from the sleep mode by the LAN module 125.

(1) A command for printing is received from the outside (PC or the like) via the LAN module 125.

(2) The signal 64 is asserted.

(3) The microcontroller 121 asserts the signal 56 and starts the second power supply circuit 112. Accordingly, powers of "24V" and "5V" are turned on to start the CPU (#1) 122.

(4) The LAN module 125 communicates with the CPU (#1) 122 (signal 64) and performs a printing operation.

When there is a command for printing from the LAN module 125, the printing conditions are set from the PC connected to the LAN modules 125 and the control panel 4 is not operated.

Accordingly, when a signal for printing from the LAN module 125 is received in the sleep mode, the control panel 4 is not started (the signal 55 is not asserted) but the modules other than the control panel 4 are started to perform printing. This reduces unnecessary power consumption.

(5) When the modules transition from the sleep mode by the LAN module 125 to start printing, the paper roll is rotated and the signal 53 is asserted.

When the same procedure for transitioning as that in the second embodiment is used, the signal 56 is asserted by the rotation signal. However, only in the case of transitioning by the LAN module 125, the signal from the encoder 18 is ignored under control of the microcontroller 121.

That is, only in the case of transitioning by the LAN module 125, even though the signal from the encoder 18 is input, the microcontroller 121 does not enable the signal 55. Accordingly, power of "5V1" is not supplied to the CPU (#2) 131 and the control panel 4 does not make a transition. As described above, printing can be performed without causing the control panel 4 to transition. Then, upon completion of the printing, the modules enter again the sleep mode. However, when the scanner sensor 36 provides an instruction for transitioning based on a detection of the LAN module 125 and printing, the control panel 4 transitions from the sleep mode.

<Transition Process>

Figure 7:
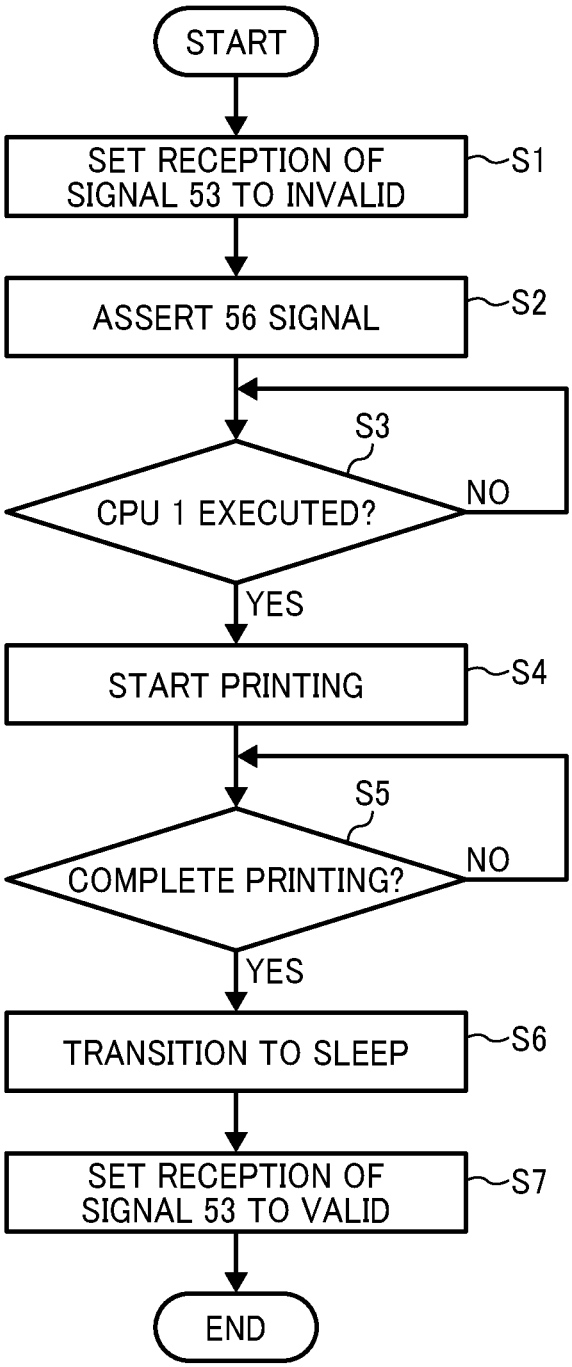
FIG. 7 is a flowchart illustrating operation of controlling transition of an operating mode, performed by the control system for the conveyance device illustrated in FIG. 6.

Next, a process for making a transition based on an output from the LAN module 125 will be explained in detail. FIG. 7 is a flowchart of a process performed by the conveyance device illustrated in FIG. 6.

In this example, a flow of the procedure for making a transition from the sleep mode, printing, and transition to the sleep mode when print job from the PC is sent to the LAN module 125 will be explained.

First, when the LAN module 125 sends a JOB instruction by the signal 64, the microcontroller 121 disables receipt of the signal 53 (return signal) from the XOR gate 124 (step S1).

Accordingly, during when a transition is made based on the print job, the control panel 4 is prohibited from making a transition even with detection of a rotation of the paper roll by the encoder 18.

Next, the microcontroller 121 asserts the signal 56 to start the second power supply circuit 112, and starts the CPU (#1) 122 with power of "5V" (step S2). This prevents wasteful power consumption due to release of the control panel 4.

The microcontroller 121 detects the start-up of the CPU (#1) 122 based on a communication between the microcontroller 121 and the CPU (#1) 122 (signal 62) (step S3). When the CPU (#1) 122 is started, the LAN module 125 and the CPU (#1) 122 communicate with each other for receiving data and the like to start printing (step S4).

Upon completion of the printing (step S5), the microcontroller 121 makes a transition again to the sleep mode (step S6). Then, finally, the microcontroller 121 enables receipt of the signal 53 to allow a transition from the sleep mode based on the signal of the encoder 18 from the XOR gate 124 (step S7).

According to the third embodiment, when a print job is received from the outside via the LAN module 125, even though the paper roll 10 is rotated and the encoder 18 outputs the rotation detection signal, power of "5V1" is not generated from power of "5V" and no power is supplied to the control panel 4.

This prohibits power from being supplied to the control panel 4 when executing a print job received from the outside, thus achieving further energy saving.

In addition, according to the third embodiment, the paper feeder 1 transitions from the sleep mode upon receipt of the rotation detection signal, an instruction from the sleep mode return switch 132, or a signal from the scanner sensor 36.

With this configuration, the control system 103 transitions from the sleep mode according to a user operation of the sleep mode return switch 132 or a document scanning operation.

Fourth Embodiment

Figure 8:
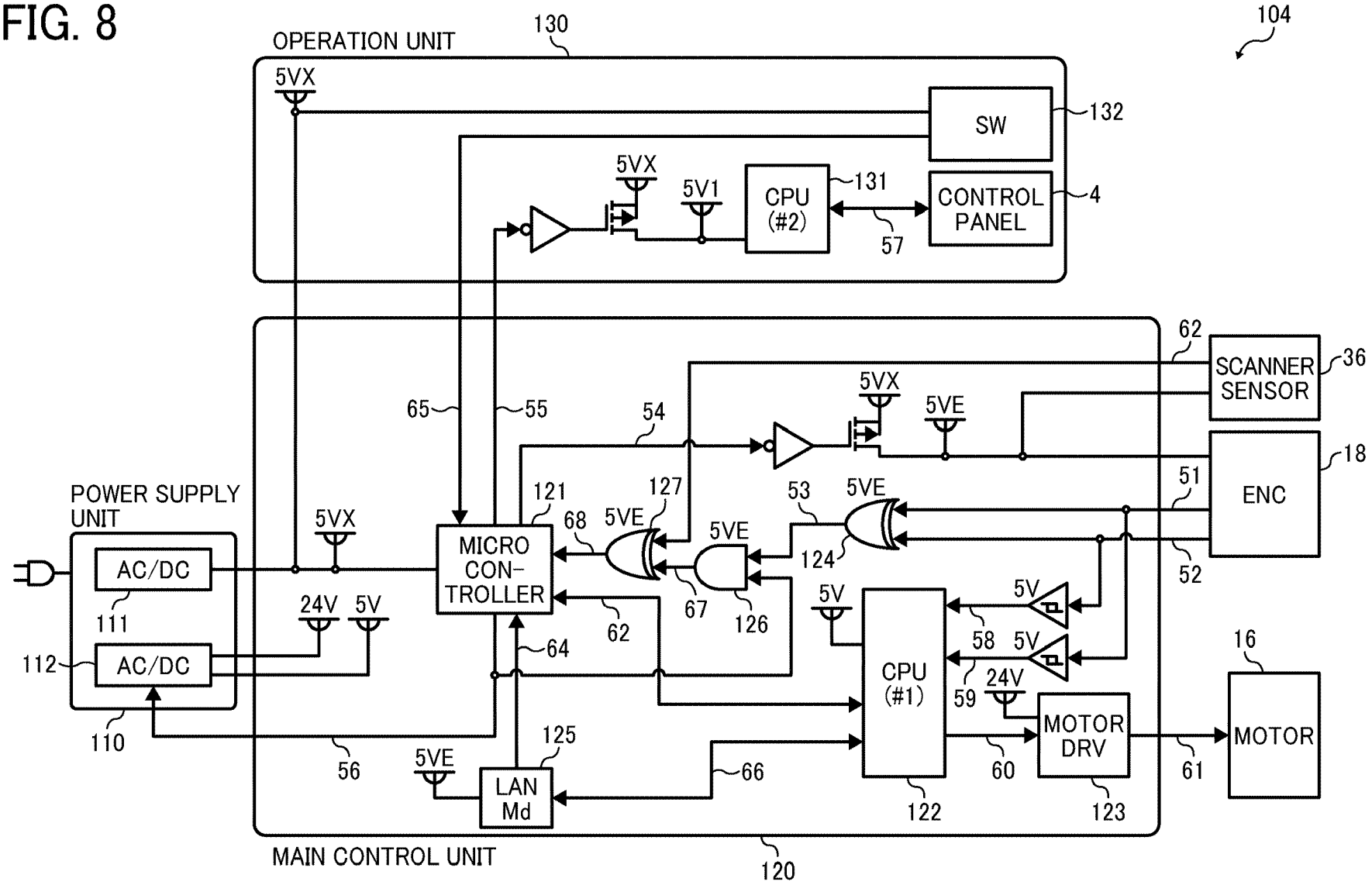
FIG. 8 is a block diagram of a control system for controlling operation of the conveyance device of FIG. 1, according to a fourth embodiment of the present invention.

Next, a process by a paper feeder 1 according to a fourth embodiment of the present invention will be explained. FIG. 8 is a block diagram of a control system 104 in the paper feeder according to the fourth embodiment of the present invention.

The difference in the control system 104 of the fourth embodiment from the control system 102 of the second embodiment is that the control system 104 additionally includes an AND gate 126 and an XOR gate 127. The AND gate 126 outputs a signal 67 based on the AND of the signal 53 and the signal 56 to the XOR gate 127. The XOR gate 127 outputs to the microcontroller 121 a signal 68 based on the XOR of the signal 67 from the AND gate 126 and the signal 62 from the scanner sensor 36.

In the fourth embodiment, the signal 56 from the microcontroller 121 to the second power supply circuit 112 is a negative logic (asserted in Low and power of "5V" is turned on). Accordingly, since the AND gate 126 ANDs the signal 56 and the signal 53, the return signal 53 from the XOR gate 124 is not input into the microcontroller 121 when the signal 56 is asserted.

Therefore, at the time of transition from the sleep mode by the signal 64 from the LAN module 125, the control panel 4 does not make a transition. More specifically, the signal 53 asserted by the printing operation after making the transition is not passed to the microcontroller 121 such that printing can be continued without causing the control panel 4 to transition.

In addition, with the provision of the XOR gate 127, the signal 62 and the signal 67 can be XORed to reduce the number of signals input into the main control unit 120.

The present invention is applicable to not only image forming apparatuses but also processing machines that convey paper from a paper roll and process the sheet of paper.

As described above, with the conveyance device of one or more embodiments, user operability is improved while suppressing power consumption of the apparatus.

For example, any one of the control systems descried above suppresses power consumption of the paper feeder 1 in the sleep mode. In addition, once the sheet, which is placed at the entry of the sheet conveyance path, is detected such as with the encoder 18, for example, at the time of setting the paper roll 10, the paper feeding motor 16 is driven to convey the sheet even in the sleep mode, thus improving user operability.

That is, power consumption of the paper feeder 1, or the image forming apparatus 5, can be suppressed in the sleep mode. In addition, the paper feeder 1 is able to drive the sheet with the paper feeding motor 16, once the sheet is placed at the entry of the sheet conveyance path at the time of setting the paper roll 10.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions to be performed by the controller of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A conveyance device for an image forming apparatus including a printing function for printing on a paper roll having a width equal to or greater than 1 meter, comprising:

a holder to hold the paper roll having a width equal to or greater than 1 meter and to rotate along with rotation of the paper roll;

a conveyor configured to convey a roll sheet of the paper roll, having a width equal to or greater than 1 meter, located at an entry of a sheet conveyance path along the sheet conveyance path;

a motor configured to apply a conveyance force to the conveyor to cause the conveyor to convey the roll sheet;

a first power supply circuit to output power when the conveyance device is in a sleep mode;

a second power supply circuit that does not output power when the conveyance device is in the sleep mode;

a sensor, configured to be supplied with the power output from the first power supply circuit and configured to output a rotation detection signal in response to rotation of the holder when the conveyance device is in the sleep mode;

a control panel to receive an instruction from a user, and configured to be non-operational when the conveyance device is in the sleep mode; and a controller configured to, in response to receiving the rotation detection signal when the conveyance device is in the sleep mode, turn on the second power supply circuit to output the power to at least the motor, to enable application of the conveyance force to the conveyer to convey the roll sheet, wherein, in response to the controller receiving the rotation detection signal output from the sensor when the conveyance device is in the sleep mode, the controller is configured to cause the control panel of the conveyance device to transition from the sleep mode to the ready mode and to be visually identifiable to the user.

2. The conveyance device of claim 1, further comprising:

a paper sensor, disposed downstream the holder and supplied with the power output from the first power supply circuit, configured to detect the roll sheet at the entry of the sheet conveyance path when the roll sheet is drawn from the paper roll, wherein, in response to the controller receiving the rotation detection signal output from the sensor when the conveyance device is in the sleep mode, the second power supply circuit is further configured to output the power to the paper sensor.

3. The conveyance device of claim 1, wherein the holder includes a plurality of holders, each holder of the plurality of holders being configured to hold the paper roll including the roll sheet having a width equal to or greater than 1 meter, the sensor includes a plurality of sensors, each respectively provided for each of the respective plurality of holders, and the controller is configured to turn on the second power supply circuit to output the power, in response to the rotation detection signal being received from at least one of the sensors.

4. The conveyance device of claim 1, further comprising:

a communication interface to receive an instruction for printing through a network;

wherein, when the controller determines that a printing operation is to be performed in response to the instruction for printing being received at the communication interface when the conveyance device is in the sleep mode, the controller is configured to prohibit the control panel from turning on, even after the controller receives the rotation detection signal output from the sensor.

5. An image forming apparatus including a printing function for printing on a roll sheet having a width equal to or greater than 1 meter, comprising:

the conveyance device according to claim 1; and an image forming device configured to form an image on the roll sheet conveyed by the conveyance device through the sheet conveyance path.

6. The conveyance device of claim 1, wherein the sensor includes an encoder, configured to output the rotation detection signal in response to rotation of the holder.

7. The conveyance device of claim 6, wherein the holder includes a plurality of holders, each holder of the plurality of holders being configured to hold the paper roll including the roll sheet having a width equal to or greater than 1 meter, the sensor includes a plurality of encoders, each respectively provided for each of the respective plurality of holders, and the controller is configured to turn on the second power supply circuit to output the power, in response to the rotation detection signal being received from at least one of the encoders.

8. A conveyance device for an image forming apparatus including a printing function for printing on a paper roll having a width equal to or greater than 1 meter, comprising:

a holder to hold the paper roll having a width equal to or greater than 1 meter, and to rotate along with rotation of the paper roll;

a sensor, configured to be supplied with power via a first power supply circuit when the conveyance device is in both a sleep mode and a ready mode, and configured to output a rotation detection signal in response to rotation of the holder; and a controller configured to, in response to receiving the rotation detection signal output from the sensor when the conveyance device is in the sleep mode, turn on a second power supply circuit to output power, to enable conveying of the roll sheet having a width equal to or greater than 1 meter, from the paper roll.

9. The conveyance device of claim 8, further comprising:

a paper sensor, disposed downstream the holder and supplied with the power output via the first power supply circuit, configured to detect an end of the paper roll at an entry of a sheet conveyance path when the end of the paper roll is drawn from the paper roll, wherein, in response to the controller receiving the rotation detection signal output from the sensor when the conveyance device is in the sleep mode, the second power supply circuit is further configured to output the power to the paper sensor.

10. The conveyance device of claim 8, wherein the holder includes a plurality of holders, each holder of the plurality of holders being configured to hold the paper roll having a width equal to or greater than 1 meter, the sensor includes a plurality of sensors, each respectively provided for each of the respective plurality of holders, and the controller is configured to turn on the second power supply circuit to output the power, in response to the rotation detection signal being received from at least one of the sensors.

11. The conveyance device of claim 8, further comprising:

a control panel to receive an instruction from a user, and configured to be non-operational when the conveyance device is in the sleep mode, wherein, in response to the controller receiving the rotation detection signal output from the sensor when the conveyance device is in the sleep mode, the controller is configured to cause the control panel of the conveyance device to transition from the sleep mode to the ready mode and to be visually identifiable to the user.

12. The conveyance device of claim 11, further comprising:

a communication interface to receive an instruction for printing through a network;

wherein, when the controller determines that a printing operation is to be performed in response to the instruction for printing being received at the communication interface when the conveyance device is in the sleep mode, the controller is configured to prohibit the control panel from turning on, even after the controller receives the rotation detection signal output from the sensor.

13. An image forming apparatus, comprising:

the conveyance device according to claim 8; and an image forming device configured to form an image on the paper roll conveyed by the conveyance device through the sheet conveyance path.

14. The conveyance device of claim 8, wherein the sensor includes an encoder, configured to output the rotation detection signal in response to rotation of the holder.

15. The conveyance device of claim 14, wherein the holder includes a plurality of holders, each holder of the plurality of holders being configured to hold the paper roll having a width equal to or greater than 1 meter, the sensor includes a plurality of encoders, each respectively provided for each of the respective plurality of holders, and the controller is configured to turn on the second power supply circuit to output the power, in response to the rotation detection signal being received from at least one of the encoders.

16. A conveyance device for an image forming apparatus including a printing function for printing on a paper roll of ten kilograms or more in weight, comprising:

a holder to hold a paper roll of ten kilograms or more in weight and to rotate along with rotation of the paper roll;

a conveyor configured to convey a sheet of the paper roll located at an entry of a sheet conveyance path along the sheet conveyance path;

a motor configured to apply a conveyance force to the conveyor to cause the conveyor to convey the sheet;

a first power supply circuit to output power when the conveyance device is both in a sleep mode and in a ready mode;

a second power supply circuit to output power when the conveyance device is in the ready mode, and to not output power when the conveyance device is in the sleep mode;

a sensor, configured to be supplied with the power output from the first power supply circuit and configured to output a rotation detection signal in response to rotation of the holder when the conveyance device is in either the sleep mode or the ready mode;

a control panel to receive an instruction from a user, and configured to be non-operational when the conveyance device is in the sleep mode; and a controller configured to, in response to receiving the rotation detection signal when the conveyance device is in the sleep mode, turn on the second power supply circuit to output the power to at least the motor, to enable application of the conveyance force to the conveyer to convey the sheet, wherein, in response to the controller receiving the rotation detection signal output from the sensor when the conveyance device is in the sleep mode, the controller is configured to cause the control panel of the conveyance device to transition from the sleep mode to the ready mode and to be visually identifiable to the user.

* * * * *